United States Patent [19]

Pou

[11] Patent Number: 4,603,629

[45] Date of Patent: Aug. 5, 1986

[54] PRINTER WITH AUTOMATICALLY ADJUSTABLE STACKER

[75] Inventor: Frederick M. Pou, Kettering, Ohio

[73] Assignee: Monarch Marking Systems, Inc., Dayton, Ohio

[21] Appl. No.: 772,863

[22] Filed: Sep. 5, 1985

[51] Int. Cl.[4] ..... B41F 13/56

[52] U.S. Cl. ..... 101/226; 270/58; 83/363

[58] Field of Search ..... 101/2, 226–228, 101/232, 238; 209/521, 569; 270/58; 400/583.3, 582, 583.4, 621; 83/363, 360, 365

[56] References Cited

U.S. PATENT DOCUMENTS

| | | | |
|---|---|---|---|
| 3,254,300 | 5/1966 | Prell | 226/20 |
| 3,398,619 | 8/1968 | Nichols et al. | 83/363 |
| 3,616,718 | 11/1971 | Giulio et al. | 83/363 |
| 3,955,502 | 5/1976 | Hofe | 101/226 |
| 4,025,025 | 5/1977 | Bartel et al. | 400/583.3 X |
| 4,372,696 | 2/1983 | Pou et al. | 400/124 |
| 4,442,774 | 4/1984 | Pou et al. | 101/226 |
| 4,527,468 | 7/1985 | Piotroski | 101/2 |
| 4,527,791 | 7/1985 | Piotruski | 270/58 |
| 4,535,892 | 8/1985 | Roes et al. | 209/569 |
| 4,538,515 | 9/1985 | Tymkewicz et al. | 400/616.1 X |

*Primary Examiner*—E. H. Elckholt

*Attorney, Agent, or Firm*—Mason, Kolehmainen, Rathburn & Wyss

[57] ABSTRACT

A printer utilizes an automatic stacker that has a conveyor belt whose speed and increment of advance is varied as a function of the size of the tag being printed in order to provide a more even overlap when different size tags are stacked in a shingle fashion.

33 Claims, 10 Drawing Figures

10
12
14
16
18
19
19'
17
17'
20
22
24
26
32
34
38
40
41
54
2
2'

10
12
14
16
18
28
30
32
34
36
38
40
46
48
50
54
74
5
3
CUTTER DRIVER 54
52
18
12
40

54
18
52
12
40

PRINTER WITH AUTOMATICALLY ADJUSTABLE STACKER

BACKGROUND OF THE INVENTION

1. Field of the Invention

This invention relates generally to printing systems, and more particularly to printing systems for printing characters in various formats onto webs of sheet stock of various widths, for cutting the web to various lengths to accommodate the various formats and for automatically stacking the tags after they are cut.

2. Description of the Prior Art

Printers capable of printing characters in various formats onto webs of various sizes are known. Such printers are described in U.S. Pat. Nos. 4,372,696 and 4,442,774, incorporated herein by reference.

While prior art printers such as the ones described in the aforementioned U.S. Pat. Nos. 4,372,696 and 4,442,774 do provide a way to print characters of various formats onto various size webs of sheet stock, the printer of the present invention provides an improved method and apparatus for transporting and stacking the various size tags.

Printers of this type generally print the required information onto the web in the desired format and then cut the web into tags of a predetermined length containing one or more tag sections. For purposes of discussion each section thus cut will be referred to as a tag regardless of the number of tags actually printed on the section. The individual tags printed on each tag will be referred to as tag sections. Moreover, since the printer according to the invention is capable of printing onto various types of web stock including, for example, stock that can be cut into labels, cards or the like, the term tags is intended to cover sections cut from various web stock, and is not limited to merchandise tags.

In prior art printers such as the ones disclosed in the aforesaid U.S. Pat. Nos. 4,372,696 and 4,442,774, tags are generally printed in batches ranging from a few tags to hundreds of tags per batch. The printed tags are cut from a web of sheet stock and exit the printer through an exit chute, which may contain a conveyor, onto a conveyor belt of a stacker. By varying the operation of the conveyor belt, the tags can be stacked in piles or stacked in a shingle fashion wherein each tag only partially overlaps the previous tag much like roof shingles only partially overlap each other. However, the amount of overlap is not optimized for the various tags of different sizes that are produced by the printer, and bunching of tags at the mouth of the exit chute can occur when short tags, which exit the chute rapidly, or wide tags are produced.

SUMMARY OF THE INVENTION

Accordingly, it is an object of the present invention to provide an improved printer-stacker combination that provides further advantages over the prior art printers.

It is yet another object of the present invention to provide a printer-stacker combination that provides a more optimum overlap between tags when different size tags are stacked in a shingle fashion than do prior art printer-stacker combinations.

It is yet another object of the present invention to provide a printer-stacker combination wherein the amount of advance and speed of the stacker is varied as a function of the size of the tags being printed.

It is yet another object of the present invention to provide a printer that checks the length and width of the stock loaded therein and varies the amount of advance and speed of the stacker as a function of the length and width of the tag.

Therefore, in accordance with a preferred embodiment of the invention, there is provided a printer-stacker combination wherein the printer controls the amount of advance and speed of the stacker as a function of the size of the tags being printed. The printer contains circuitry for determining the width and length of the tags being printed, and if tags that are shorter than a predetermined length or wider than a predetermined width are being printed, the amount of advance and speed of the stacker are increased. The advance and speed of the stacker is controlled by controlling the advance and speed of a conveyor belt within the stacker onto which the tags are expelled by the printer. Thus, by altering the amount of advance and speed of the conveyor, more optimum overlap in the shingling mode is achieved.

BRIEF DESCRIPTION OF THE DRAWING

These and other objects and advantages of the present invention will become readily apparent upon consideration of the following detailed description and attached drawing, wherein:

FIG. 6 is a functional block diagram of the control system employed in the printer stacker according to the invention;

DETAILED DESCRIPTION OF THE PREFERRED EMBODIMENT

Figure 1:
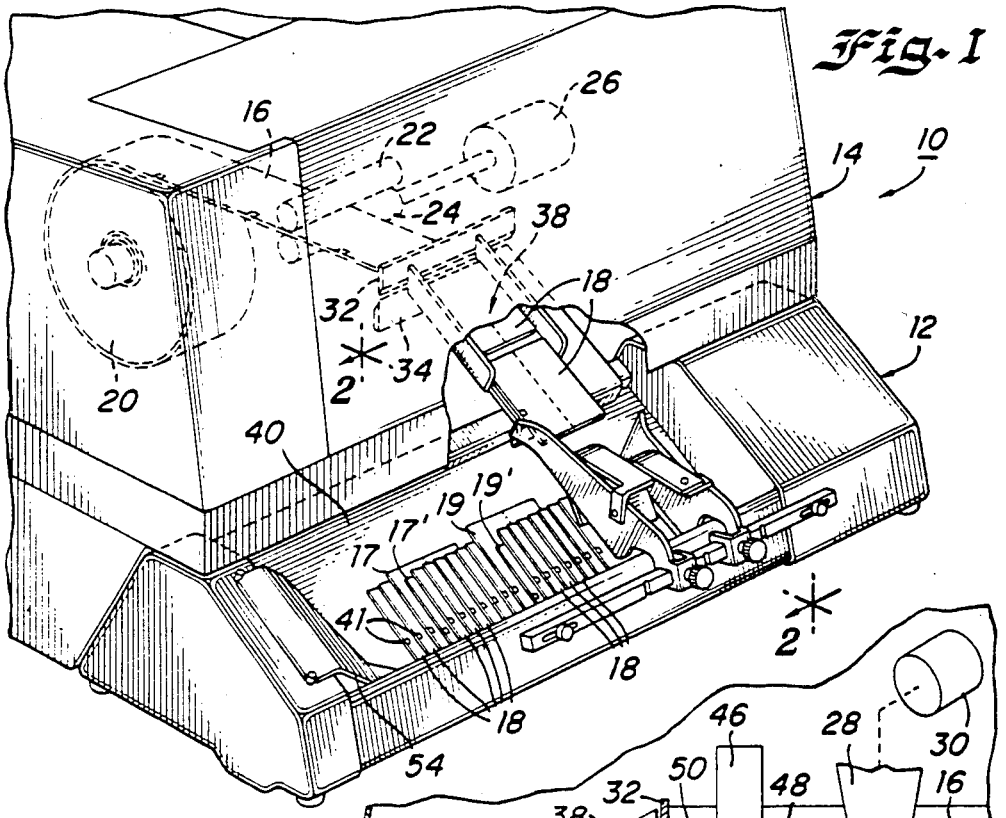
FIG. 1 is a partially simplified perspective view of the stacker-printer according to the invention.

Referring now to the drawing, with particular attention to FIG. 1, the stacker-printer according to the invention is generally designated by the reference numeral 10. The stacker-printer 10 according to the invention includes a stacker portion 12 and a printer portion 14. The printer portion 14 is similar to the printer illustrated in the aforesaid U.S. Pat. No. 4,372,696, and for this reason is illustrated in simplified form. The function of the printer 14 is to print alphanumeric or special characters onto a web of sheet stock 16 that is subsequently cut into a plurality of tags 18 that are stacked by the stacker 12. The web 16 is stored on a roll 20 and advanced through a printing station (not shown in FIG. 1) by a pair of rollers 22 and 24, one or both of which may be driven by a paper advance motor 26, which is preferably a stepping motor.

The printing on the sheet stock occurs at a printing station which includes a print head 28, which preferably includes a matrix type wire printer, but may be a thermographic or any other suitable type of print head. The print head is moved across the web stock 16 in a direction transverse to the longitudinal axis of the web 16 by a carriage driver motor 30 which is also preferably a stepping motor. After being printed, the web stock 16 is advanced to a cutting station having a pair of cutter blades 32 and 34, one or both of which may be driven by a cutter driver 36 which activates the cutter blades at predetermined intervals to cut the web 16 into tags 18 of a length determined by the format of the tag being printed. After the web stock has been cut into the tags 18, the tags exit through an exit chute or conduit 38 onto a conveyor belt 40 of the stacker 12.

The length to which the tags 18 may be cut is variable, not only to accommodate different formats, but also to provide a separation between batches of tags, as well as groups of batches. When tags are printed, the operator is given a written order defining the tags to be printed. The order typically has an order number or some other form of identification associated with it that defines the batches of tags to be printed. For example, an order may state that a batch of 100 tags of a certain format is required. Additional information for that batch can include, for example, price, an item code, and possibly a description of the item, such as, for example, a size 12 red dress. The operator reads the order and enters the pertinent information defining the batch into the printer, and proceeds with the printing.

Figure 3:
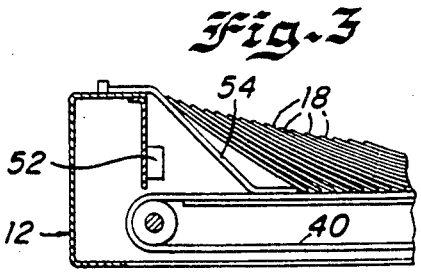
Figure 5:
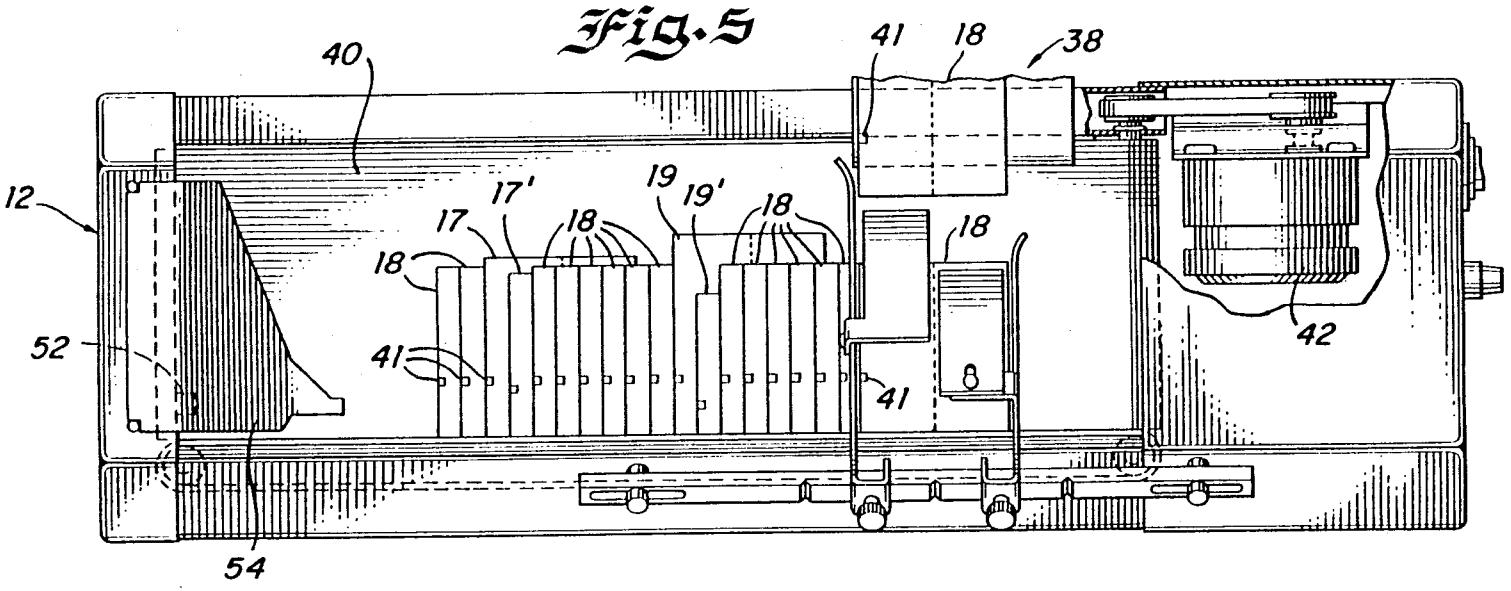
FIG. 5 is a top view of the stacker, partially in cross section, taken along line 5—5 of FIG. 2.

Once printing is initiated, the operator reads the information defining the next batch of tags, which may be a 50 tag batch having a price for a size 8 blue dress. The operator proceeds to enter all of the information defining each batch until the complete order is entered. The operator then proceeds to the next order and enters it in a similar manner. The printer then prints the various batches of tags in the same sequence in which they were entered, or in another sequence if desired, and outputs the tags through the exit chute or conduit 38, and onto the conveyor belt 40. The conveyor belt 40 is driven by a motor 42 (FIG. 5), which may be any suitable motor, but is preferably a stepping motor. The conveyor belt 40 can be moved intermittently by the motor 42 after several tags have been produced in order to stack the tags in piles, or moved after the production of each tag to stack the tags 18 in a shingle fashion as illustrated in FIGS. 1 and 3. After the tags are stacked, they are periodically removed from the conveyor belt 40 by the operator and packed with their respective orders.

In many instances, the tags of the various batches are very similar to each other, particularly batches from a single order. Thus, to facilitate the separation of the batches, the device according to the invention inserts a tag 17 that is longer than the tags 18 comprising the batch after all the tags 18 comprising the batch have been printed. The long tag 17 is followed by a short tag 17' (FIG. 1) that is shorter than the tags 18 comprising the batch. Typically, the short tag 17' is shorter than the batch tags 18 by an amount equal to the amount that the long tag is longer than the batch tags.

In addition to separating the various batches, the operator must also separate the various orders. Such separation is facilitated by the stacker-printer according to the invention by inserting an extra long tag 19 that is longer than the long tags 17 between tags of different orders. The extra long tag 19 is likewise followed by an extra short tag 19' that is shorter than the normal batch tag 18 by an amount equal to the amount by which the extra long tag is longer than the normal batch tags. Thus, the stacker-printer according to the invention provides two or more levels of separation of tags into batches and into groups of batches, and if desired, additional levels of separation may be provided.

A web index sensor 46 is used to sense the indices 41. The indices 41 may be any suitable indices, such as, for example, printed marks, notches or holes, but in the illustrated embodiment, the indices 41 are formed by fluorescent material disposed along one edge of the web 16. The sensor 46 may be any suitable sensor, but in the illustrated embodiment includes a source of ultraviolet light 48 and a photoelectric sensor 50. The source of ultraviolet light 48 excites one of the fluorescent indices along the edge of the web 16 as it passes thereunder and causes it to fluoresce. The fluorescent material continues to fluoresce for some time after being exposed to the ultraviolet light. This fluorescence is detected by the photoelectric detector 50 as the index passes thereunder.

Finally, a conveyor sensor 52 senses the presence of tags thereunder (FIG. 4) and provides a signal indicating the stacker is full and stops the printing process. The sensor 52 contains a light source and photoelectric detector that detects light reflected from the tags. The sensor 52 may be defeated by lowering a ramp 54 thereover, as is illustrated in FIG. 3, in order to prevent the tags from passing under the sensor 52.

Data is input into the printer according to the invention by a data input terminal 51 (FIG. 6) which may be a cathode ray tube data input terminal, another computer or simply a keyboard. The output of the data input 51 may be in various forms, for example, in the form of ASCII characters which are applied to a processor 53 within the printer via an interface 54. The function of the processor is to receive data from the data input terminal 51 and to convert it to a form suitable for driving the print head 28, the web advance motor 26, the cutter 34, the stacker motor 42 and the carriage motor 30 in order to generate the desired characters at the desired positions on the web being printed, to cut the web into tags of appropriate lengths and to stack the cut tags in an appropriate manner.

The system according to the present invention stores various types of information. The information that is stored includes information defining the various fonts, which is stored in a font storage location 56; data defining the format in which a particular tag or label is to be printed, which is stored in a format storage location 58; and data defining the alphanumeric or special characters that are to be printed, the format that is to be utilized, the number of tags to be printed and the type of stacking required, which is stored in a data storage location 60.

The length and width of the tag necessary to accommodate the selected format is also stored in the format storage. This information is printed whenever a new format is selected to assure that the operator has placed the correct size web into the printer. The number of tags to be printed, as well as the number of tag sections to be printed between cuts, is also stored in the format storage 58 in order to control the cutter 34 to cut the tags to the length, and to insert the longer and shorter tags between batches, and between groups of batches, as previously discussed.

The data stored in the data storage 60 includes data representative of the particular characters to be printed on a tag. This data is used in conjunction with the format storage data and font storage data, and printing is controlled by selecting a particular font from the font data storage 56 and a particular format from the format data storage 58. The processor 53 then inserts data from the data storage 60 in the appropriate places defined by the format storage 58 and prints the data in the appropriate fonts defined by the font storage 56. When printing, the microprocessor 53 converts the data stored in the data storage 60, the format storage 58 and the font storage 56 to signals that actually control the printing. These signals take the form of carriage control signals which are amplified by a carriage driver 29 which in turn actuates the carriage motor 30 which controls the movement of the print head 28. Other signals which determine which pins of the print head are to be fired or actuated are amplified by a print head driver 66 and used selectively to actuate the various pins of the print head 28. A paper advance driver 68 amplifies the signals from the processor 53 and controls the position of the paper advance motor 26. A cutter driver 36 amplifies the signals from the processor 53 and causes the cutter 34 to be activated at predetermined intervals as determined by signals from the web index sensor 46 and the data in the data storage 60 and the format storage 58. A stacker motor driver 72 amplifies signals from the processor 53 in order to drive the stacker motor 42 in accordance with the mode of stacking selected (shingle or pile) and the data in the format storage 58 and the data storage 60. The processor 53 also receives signals from the chute tag sensor 42 and the conveyor sensor 52, and terminates the printing in the event of a jam in the chute or a full stacker.

Stacker-Printer Operation and Logic

Figure 4:
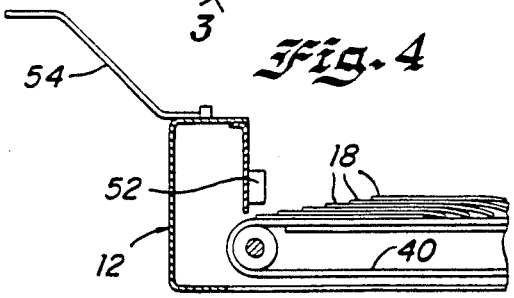
FIGS. 3 and 4 are sectional views of the stacker taken along line 3—3 of FIG. 2 and showing two different modes of operation of the stacker.

The mode of operation of the stacker-printer can be selected by the operator by any suitable input to the data input 51. In the illustrated embodiment, the stacker-printer is designed to operate in a stack in piles mode and a shingle mode which may readily be selected by the operator via the data input 51. In the stack in piles mode, up to 30 tags are stacked in a single pile. In the shingle mode, tags exit the exit chute 38 and slide onto the conveyor belt 40 as illustrated in FIG. 1. In this mode, each time a tag exits the chute 38, the conveyor belt 40 is advanced a predetermined amount, generally on the order of approximately ¼", to achieve the shingle effect. In this mode, the ramp 54 may be lowered to the position illustrated in FIG. 3 to permit the tags to be turned upright to permit a large number of tags to be stored in the stacker. Alternatively, the ramp 54 may be placed in an upward position as illustrated in FIG. 4 to permit the tags to be sensed by the sensor 52 when the stacker is full.

In the stack in piles mode, the conveyor belt 40 is not advanced after each tag is printed as in the case the shingle mode, but rather, the conveyor belt 40 remains stationary until any desired number of tags up to, for example, 30 tags, are printed. After the desired number of tags or the 30 tags have been printed, or after a batch has been completed, the conveyor belt 40 is advanced by an increment approximately equal to or slightly greater than the width of the stack of tags, and a new pile is started.

Figure 7:
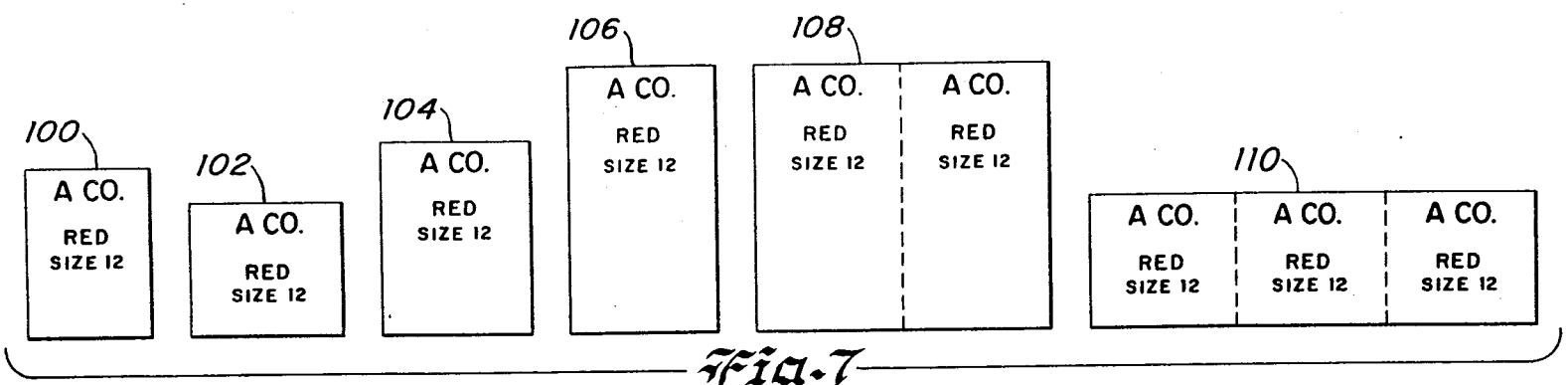
FIG. 7 is an illustration of the various tags that can be printed by the system according to the invention.

In addition to the various batch separation tags that were previously discussed, the printer according to the invention can also make batch tags of various lengths and widths and single and multiple part tags. Examples of such tags are illustrated in FIG. 7. For example, the printer can produce relatively short tags such as tags 100 and 102 (FIG. 7), medium length tags 104 and long tags 106. The width of the tags can also be varied, and in the illustrated embodiment, the width of the tag 100 is one inch and the width of the tags 102, 104 and 106 are 1.2 inches. The length of the tags 100, 102, 104 and 106 are 1.375 inches, 1.1 inches, 1.6 inches and 2.2 inches, respectively. In addition, the printer can print multiple part tags on perforated webs, such as for example, a two-part tag 108 and a three part tag 110. For example, the tag 108 may be a two section tag containing a pair of tags each 1.2 inches wide and 2.2 inches long. The tag 110 may contain, for example, three tag sections each 1.2 inches wide by 1.1 inches long.

Because of the diverse sizes and shapes of the tags 100, 102, 104, 106, 108 and 110, as well as the amount of information necessary to be printed on such tags, the time required to print the various tags varies considerably, thereby varying the rate at which the tags are produced. This causes the amount of overlap between tags when stacked in the shingle mode to vary as a function of the size and shape of the tag when the conveyor belt 40 is operated at a constant speed. Also, when short tags that exit the chute in rapid succession are printed, a jam may occur at the outlet of the chute because the tags are produced faster than they can be removed by the belt 40. Similarly wide, multi-part tags can cause a jam because they may not be moved clear of the chute outlet before subsequent tags are printed. Thus, in order to achieve a more uniform offset between tags in the shingle mode, and to avoid the pile-up or jam problem, the increment that the conveyor belt 40 is advanced and its speed are varied as a function of the length and width of the tags being produced to provide a more uniform shingling effect and to avoid pile-up. However, before discussing how the increment of advance and the speed of the conveyor belt 40 are altered, it will be useful to discuss how the length and width of the tags is determined.

The width and length determination is employed whenever a change in format occurs between batches. When a format change occurs, the length and width of tags necessary to accept the format are calculated and compared with the length and width of the stock previously loaded into the printer. If the stock loaded in the printer is not compatible with the requirements of the new format, information defining the necessary length and width is printed onto the stock then in the printer in a format small enough to fit onto the smallest stock that can be accepted by the printer. Printing then terminates, and the operator must load new stock into the printer before printing can resume.

Figure 2:
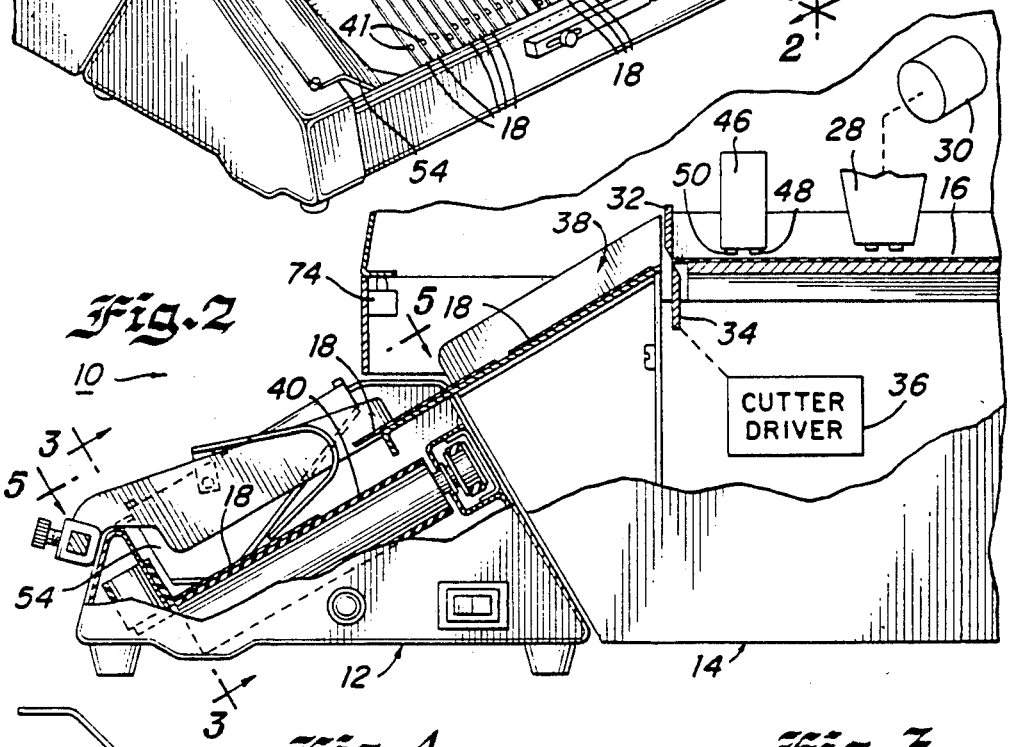
FIG. 2 is a side sectional view of the stacker taken along line 2—2 of FIG. 1.

The above function is performed by the system which compares the length and width requirements of the new format stored in the format storage 58 with the length and width requirements of the format of the previously printed batch. If the values are not the same, the message with the correct values is printed. A sensor senses the position of an out of stock switch (not shown) or a printer carriage open switch 74 (FIG. 2) to determine that the stock has been changed. The operator then enters data defining the width of the stock just loaded into the system via the data input 51. Alternatively, a width sensor (not shown) that automatically senses the width of the web may be provided. The length information is determined directly from the newly loaded web by sensing the distance between web indices on the stock via the web index sensor 46. If the width and length information thus loaded now concurs with the requirements of the selected format, printing may proceed. If not, the tag length and width required by the selected format is again printed on the web and printing is terminated.

Figure 8:
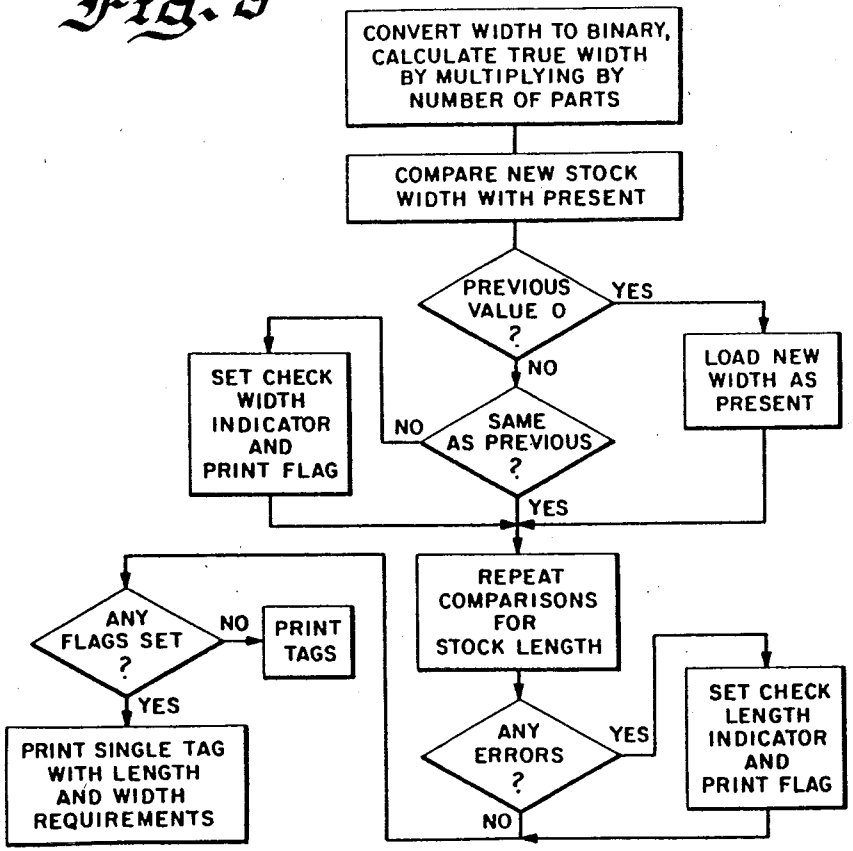

The logic employed by the stock width and length check is illustrated in FIG. 8. As illustrated in FIG. 8, the required width is converted to binary and true width is calculated by multiplying the width requirements of the format stored in the format storage 58 by the number of parts forming the tag in the event that a multiple part tag is being printed. For example, if two-part or three-part tags such as those illustrated in FIG. 7 were utilized, the format width requirement would be multiplied by two or three, respectively. The required stock width is compared with the width of the stock presently loaded in the machine. At the same time, a determination is made as to whether or not the previous value of stock width was zero, with zero indicating either that new stock was put into the machine or that a power up condition exists. If the previous value is zero, the new width is loaded as the present width, and the stock length comparisons are made. If the previous value of width is not zero, the comparison between the previous and present stock width is made. If the two values are the same, the stock length comparisons are made. If not, the check width indicator and the print flag are set before the stock length comparisons are made. After the stock length comparisons are made, if there is an error, the check length indicator and the print flag are set. A determination is then made as to whether any flags are set. If not, the printing of tags commences. If a print flag indicative of an incorrect width or an incorrect length has been set, a single tag with the tag length and width requirements required by the selected format is printed. The printing of length and width information is done in a format that can be accommodated by the smallest tag that can be utilized by the printer. No further printing occurs until the stock is changed.

The stock length check described above is provided automatically by automatic length detection circuitry assures that the length of the tag stock loaded in the machine is compatible with the selected format to thereby minimize the possibility of printing onto wrong or faulty stock. The detection is automatically achieved by comparing the spacing between web stock indices with the spacing required by the selected format.

Figure 9:
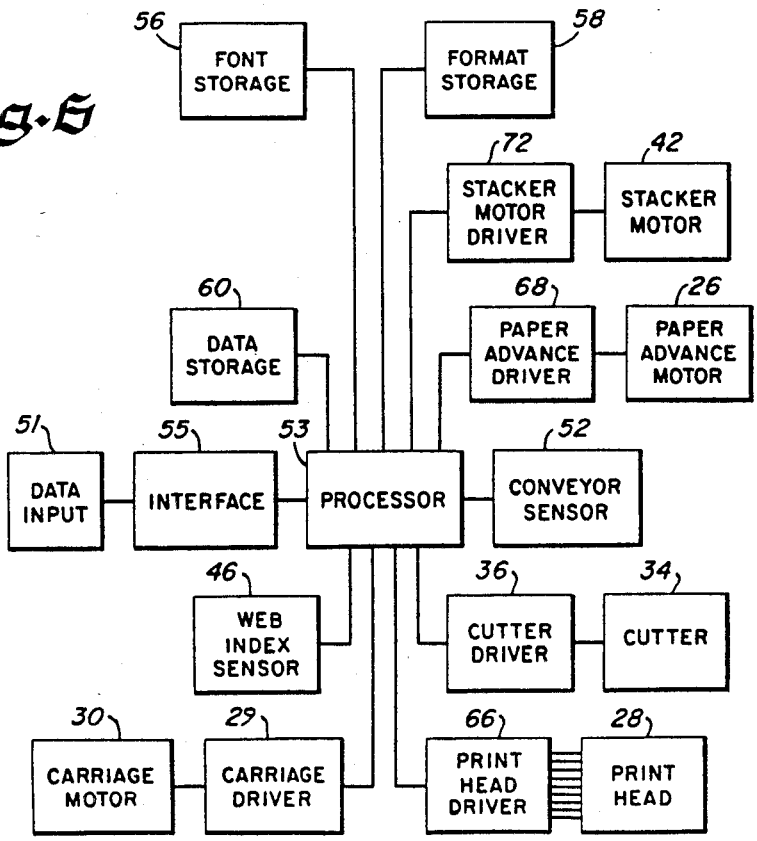
FIGS. 8–10 are functional flow charts illustrating the logical operation of the control circuitry of the stacker-printer according to the invention.

The logic for accomplishing the length detection as well as determining whether or not the increment of advance and speed of the conveyor belt are to be increased is illustrated in FIG. 9. As is illustrated in FIG. 9, the required tag length, as determined by the format storage 58, is loaded. A comparison is then made to determine whether the length of the tag is greater than a predetermined length, for example, 1.6 inches. If it is, the tag width and the number of parts forming the tag are loaded from the format storage 58. A determination is then made to determine whether the tag is a single or a multi-part tag. If the tag is not a multi-part tag, the number of steps that must be applied to the paper advance motor 26 to advance the web 16 an amount equal to the required tag length is calculated. If the tag length is not greater than 1.6 inches, or if the tag is a multi-part tag, a wide stack pulse is loaded before the number of steps that must be applied to the paper advance motor are calculated.

The purpose of the wide stack pulse is to indicate to the system that the stacker motor is to be incremented by a wider increment, rather than a standard, narrower increment, and that the stacker motor is to be operated at a higher speed. The wide stack pulse is used preferably to increase the speed and increment of the conveyor, but either the speed or the increment may be increased independently of the other. Typically, the width of the increment is increased on the order of approximately 35% to 40%, and the speed of the motor is increased by approximately 20% to 25%. If a stepping motor is used as the stacker motor 42, the repetition rate of the pulses applied to the stepper motor is increased, and in addition, the length of time that the pulses are applied is increased. If another type of motor is used, the voltage or current drive to the motor can be increased, as can the time that the motor is energized. The use of the wide stack pulse is illustrated in greater detail in FIG. 10 and in the description of FIG. 10 which follows.

The web 16 is then advanced, and the steps are counted as each tag is printed. The counts are then compared to a stored step count representative of the maximum length of tag that can be tolerated by the system. If the step count reaches a number representative of the maximum length, a jam condition is indicated. As long as the step count is less than the maximum length representative count, the web index sensor 46 is monitored until a web index is found. When the web index is found, the step count present at the time the web index is detected is compared with a stored count indicative of the minimum length of tag usable with the selected format. If the count is less than or equal to the count corresponding to the minimum length of tags that can be utilized with the selected format, a jam condition is indicated. If not, the monitoring continues.

Figure 10:
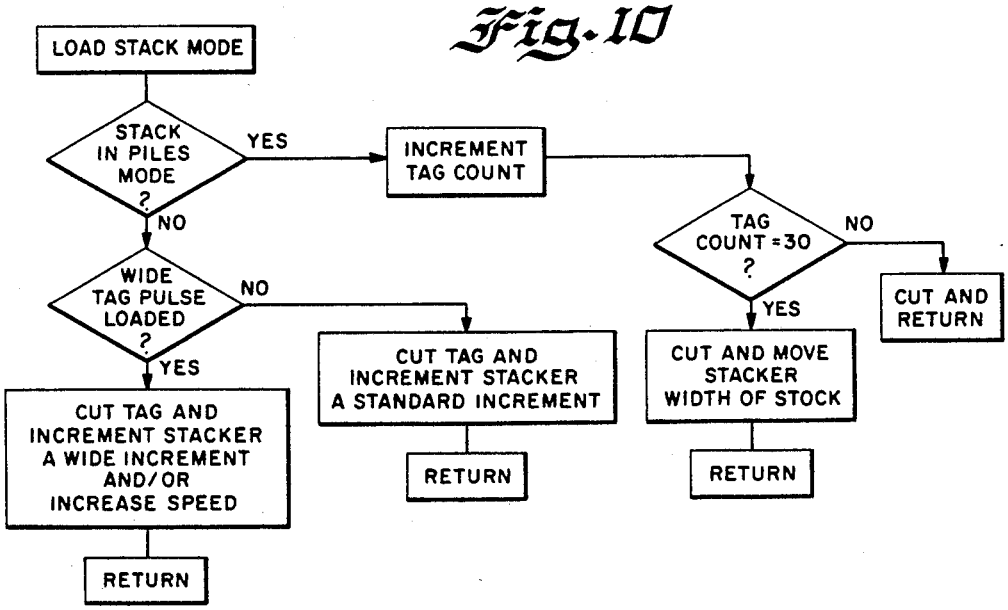
Figure 9:
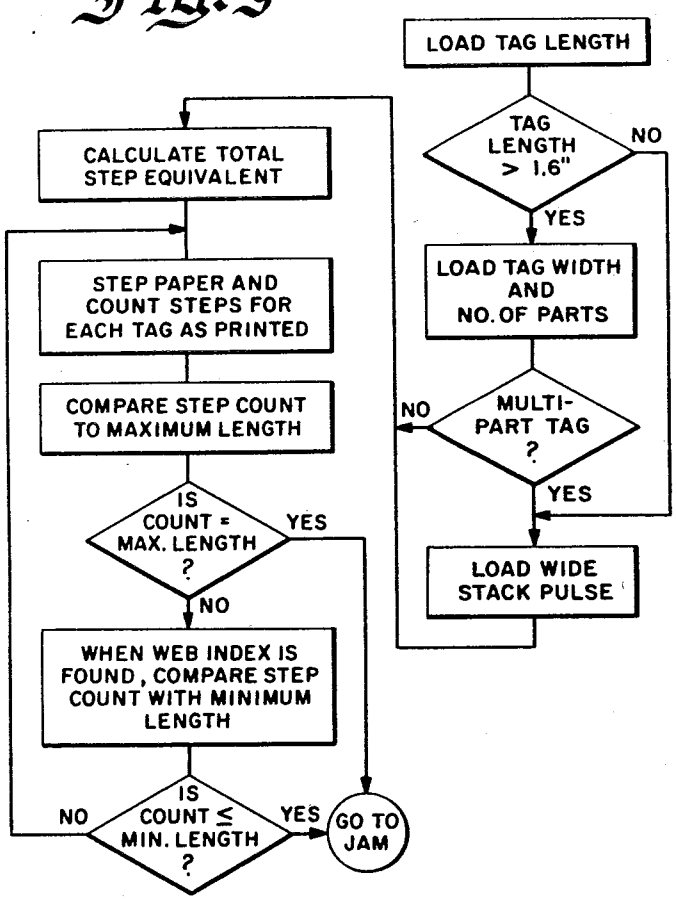

The logic for determining when, how much and how fast the conveyor is to be incremented is shown in FIG. 10. Referring to FIG. 10, the mode of stacking, that is, whether the stack in piles or shingle mode has been selected, is loaded. If the stack in piles mode has been selected, the tag count is incremented and tags are cut without incrementing the conveyor belt until a predetermined number of tags, for example, 30 tags have been printed. When the predetermined count is reached, the last tag is cut and the conveyor is moved the width of the web stock, or preferably an increment slightly greater than the width of the web stock, before the next tag is printed.

If the stack in piles mode has not been selected, it is assumed that the shingle mode has been selected and a check is made to determine whether the wide tag pulse has been loaded. If the wide tag pulse has not been loaded, the tag is cut and the stacker motor 42 is advanced the standard, narrower increment at the standard, lower speed. If the wide tag pulse has been loaded, the tag is cut and the stacker is incremented by a wide increment at the increased speed each time the tag is cut.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In a printer-stacker of the type having means for printing data onto a web of sheet stock, means for cutting the web into tags, means for storing data representative of the width and length of the tags to be printed, and a stacker for receiving and stacking the tags, said stacker having a conveyor for receiving said tags and means for advancing said conveyor a predetermined increment each time a tag is produced, the improvement comprising:

means for determining the predetermined increment of advance of said conveyor; and means responsive to the data storing means for altering the predetermined increment of advance as a function of the data stored therein.

2. The improvement recited in claim 1 wherein said altering means is responsive to the data representative of the length of the tag for altering the predetermined increment as a function of the length of the tag.

3. The improvement recited in claim 2 wherein said altering means is responsive to the length representative data for increasing the predetermined increment if the tag is shorter than a predetermined length.

4. The improvement recited in claim 3 wherein said predetermined increment is increased on the order of approximately 35 to 40 percent.

5. The improvement recited in claim 1 wherein said altering means is responsive to the data representative of the width of the tag for altering the predetermined increment as a function of the width of the tag.

6. The improvement recited in claim 5 wherein said altering means is responsive to the width representative data for increasing the predetermined increment if the tag is wider than a predetermined width.

7. The improvement recited in claim 6 wherein said predetermined increment is increased on the order of 35 to 40 percent.

8. The improvement recited in claim 1 wherein said data storing means includes means for storing data representative of the number of tag sections to be printed across the width of a tag, and wherein said altering means is responsive to the tag section number representative data for altering the predetermined increment as a function of the number of tag sections to be printed across the tag.

9. The improvement recited in claim 8 wherein said altering means is responsive to the tag section number representative data for increasing the predetermined increment if the number of tag sections is greater than a predetermined number.

10. The improvement recited in claim 9 wherein said predetermined number of tag sections is one.

11. The improvement recited in claim 9 wherein said predetermined increment is increased on the order of approximately 35 to 40 percent.

12. In a printer-stacker of the type having means for printing data onto a web of sheet stock, means for cutting the web into tags, means for storing data representative of the width and length of the tags to be printed, and a stacker for receiving and stacking the tags, said stacker having a conveyor for receiving said tags and means for advancing said conveyor at a predetermined speed each time a tag is produced, the improvement comprising:

means for determining the predetermined speed of said conveyor; and means responsive to the data storing means for altering the speed of said conveyor as a function of the data stored therein.

13. The improvement recited in claim 12 wherein said altering means is responsive to the data representative of the length of the tag for altering the speed as a function of the length of the tag.

14. The improvement recited in claim 13 wherein said altering means is responsive to the length representative data for increasing the speed if the tag is shorter than a predetermined length.

15. The improvement recited in claim 14 wherein said speed is increased on the order of approximately approximately 20 to 25 percent.

16. The improvement recited in claim 12 wherein said altering means is responsive to the data representative of the width of the tag for altering the speed as a function of the width of the tag.

17. The improvement recited in claim 16 wherein said altering means is responsive to the width representative data for increasing the speed if the tag is wider than a predetermined width.

18. The improvement recited in claim 17 wherein said speed is increased on the order of approximately 20 to 22 percent.

19. The improvement recited in claim 12 wherein said data storing means includes means for storing data representative of the number of tag sections to be printed across the width of a tag, and wherein said altering means is responsive to the tag section number representative data for altering the speed as a function of the number of tag sections to be printed across the tag.

20. The improvement recited in claim 19 wherein said altering means is responsive to the tag section number representative data for increasing the speed if the number of tag sections is greater than a predetermined number.

21. The improvement recited in claim 20 wherein said predetermined number of tag sections is one.

22. The improvement recited in claim 20 wherein said speed is increased on the order of approximately 20 to 25 percent.

23. In a printer-stacker of the type having means for printing data onto a web of sheet stock, means for cutting the web into tags, means for storing data representative of the width and length of the tags to be printed, and a stacker for receiving and stacking the tags, said stacker having a conveyor for receiving said tags and means for advancing said conveyor a predetermined increment at a predetermined speed each time a tag is produced, the improvement comprising:

means for determining the predetermined speed and increment of advance of said conveyor; and means responsive to the data storing means for altering the predetermined speed and increment of advance as a function of the data stored therein.

24. The improvement recited in claim 23 wherein said altering means is responsive to the data representative of the length of the tag for altering the predetermined speed and increment as a function of the length of the tag.

25. The improvement recited in claim 23 wherein said altering means is responsive to the length representative data for increasing the speed and predetermined increment if the tag is shorter than a predetermined length.

26. The improvement recited in claim 25 wherein said predetermined increment is increased on the order of approximately 35 to 40 percent, and the speed is increased on the order of approximately 20 to 25 percent.

27. The improvement recited in claim 23 wherein said altering means is responsive to the data representative of the width of the tag for altering the predetermined speed and increment as a function of the width of the tag.

28. The improvement recited in claim 27 wherein said altering means is responsive to the width representative data for increasing the predetermined speed and increment if the tag is wider than a predetermined width.

29. The improvement recited in claim 28 wherein said predetermined increment is increased on the order of 35 to 40 percent, and said predetermined speed is increased on the order of approximately 20 to 25 percent.

30. The improvement recited in claim 23 wherein said data storing means includes means for storing data representative of the number of tag sections to be printed across the width of a tag, and wherein said altering means is responsive to the tag section number representative data for altering the predetermined speed and increment as a function of the number of tag sections to be printed across the tag.

31. The improvement recited in claim 30 wherein said altering means is responsive to the tag section number representative data for increasing the predetermined speed and increment if the number of tag sections is greater than a predetermined number.

32. The improvement recited in claim 31 wherein said predetermined number of tag sections is one.

33. The improvement recited in claim 31 wherein said predetermined increment is increased on the order of approximately 35 to 40 percent, and said predetermined speed is increased on the order of approximately 20 to 25 percent.

* * * * *